US005985384A

United States Patent [19]

Shibata

[11] Patent Number: 5,985,384

[45] Date of Patent: Nov. 16, 1999

[54] SEALED POUCH

[75] Inventor: Yukihiko Shibata, Nagoya, Japan

[73] Assignee: Daiwa Gravure Co., Ltd., Aichi-ken, Japan

[21] Appl. No.: 08/800,614

[22] Filed: Feb. 14, 1997

[51] Int. Cl.[6] ..... B32B 3/02; B32B 3/08; B32B 15/08; B32B 27/20

[52] U.S. Cl. ..... 428/34.4; 428/35.2; 428/35.3; 428/35.7; 428/35.8; 428/35.9; 428/192; 428/194; 428/206; 428/208; 428/209; 428/210; 428/323; 428/325; 428/328

[58] Field of Search ..... 428/34.4, 34.5, 428/34.6, 34.7, 35.2, 35.3, 35.4, 35.7, 35.8, 35.9, 325, 406, 192, 194, 208, 209, 210, 328, 330; 383/200, 201

[56] References Cited

U.S. PATENT DOCUMENTS

| | | | |
|---|---|---|---|
| 4,241,130 | 12/1980 | Barnes | 428/216 |
| 5,512,337 | 4/1996 | Littmann et al. | 428/35.4 |
| 5,656,355 | 8/1997 | Cohen | 428/325 |
| 5,683,802 | 11/1997 | Murschall et al. | 428/325 |

FOREIGN PATENT DOCUMENTS

| | | |
|---|---|---|
| 16230/92 | 11/1992 | Australia . |
| 0407123A2 | 1/1991 | European Pat. Off. . |
| 0473517A2 | 3/1992 | European Pat. Off. . |

*Primary Examiner*—Ellis Robinson
*Assistant Examiner*—Sandra M. Nolan
*Attorney, Agent, or Firm*—Fildes & Outland, P.C.

[57] ABSTRACT

A sealed pouch made of a laminated sheet comprising a plurality of synthetic resin films, or comprising a synthetic resin film and a layer of other material than the synthetic resin film, such as an aluminum foil, has a plurality of sides. At least one of the sides has an edge portion coated with a coating layer containing granules of ceramic, metal or the like.

10 Claims, 12 Drawing Sheets

SEALED POUCH

FIELD OF THE INVENTION

This invention relates to a sealed pouch which is made of a laminated sheet comprising a plurality of synthetic resin films, or of a laminated sheet comprising a synthetic resin film and a layer of other material such as an aluminum foil.

BACKGROUND OF THE INVENTION

Various kinds of known sealed pouches for use in holding seasoning or the like therein are made of a laminated sheet of the type described above. Sealing of such pouches is carried out by heat sealing their edge portions.

To open such a sealed pouch for taking out a content therefrom, it is necessary to tear the laminated sheet. However, the known sealed pouches involve such a technical problem that unless the heat sealed portion of the pouch is formed with a notch for facilitating the tearing of the laminated sheet, the sealed pouch may not be opened without using scissors or the like.

DISCLOSURE OF THE INVENTION

This invention is directed to solving such a problem, and accordingly a primary object of the invention is to provide a sealed pouch made of a laminated sheet comprising a plurality of synthetic resin films, or of a laminated sheet comprising a synthetic resin film and a layer of some other material such as an aluminum foil, such that the laminated sheet can be readily torn for opening the pouch without necessitating any notch formed in the laminated sheet or use of scissors or the like.

In order to accomplish the foregoing object, there is provided a sealed pouch made of a laminated sheet comprising a plurality of synthetic resin films, or a laminated sheet comprising a synthetic resin film and a layer of such a material as an aluminum foil which is other than the synthetic resin film, the sealed pouch having a plurality of sides, at least one of the sides having an edge portion formed with a coating layer which contains granules of ceramic, metal or the like.

According to the invention, therefore, when some tearing force is applied to that portion of the sealed pouch which defines the coating layer, the laminated sheet is partially broken by granules present in the portion to which the tearing force is applied, so that the sealed pouch can be readily torn and opened.

DESCRIPTION OF THE EMBODIMENTS

Figure 1:
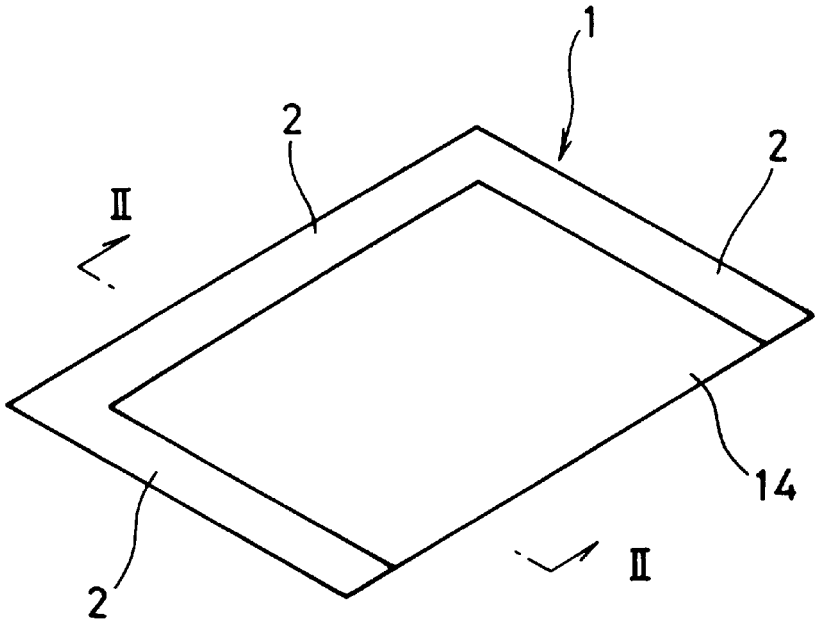
FIG. 1 is a perspective view of a sealed pouch representing one embodiment of the invention.
Figure 2:
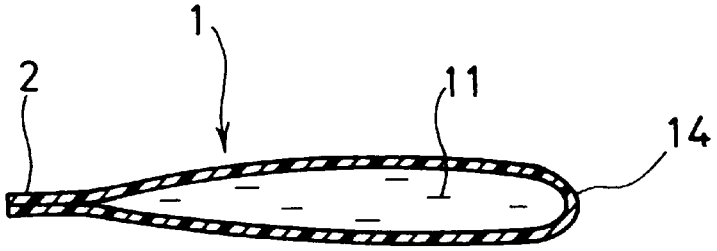
FIG. 2 is a section taken along line II—II in FIG. 1.
Figure 3:
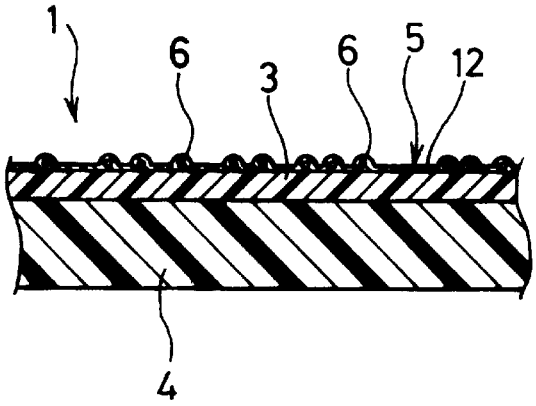
FIG. 3 is a partial enlarged view in section of the sealed pouch.

In FIGS. 1 to 3, numeral 1 designates a sealed pouch in accordance with the invention which is made of a synthetic resin film, and is tightly closed with seasoning 11 or the like packaged therein in liquid or powder form. The sealed pouch 1 is made of, for example, a rectangular sheet folded double to define a quadrilateral as shown, such that three of its four sides, other than the folded portion 14, are closed by heat sealing. Portions shown by numeral 2 are heat sealed portions.

As FIG. 3 illustrates, the sheet is comprised of a stretched film 3 of nylon and an unstretched film 4 of polyethylene which are bonded to each other, and a coating layer 5 is formed, in the process of fabricating the sheet, to cover the entire surface of the stretched film 3 positioned on the outer surface side of the pouch 1. The coating layer 5 contains a binder resin mass 12 which preferably comprises urethane resin, vinyl resin and wax in combination if the stretched film 3 is a biaxially oriented nylon film. In case that the stretched film 3 is a biaxially oriented polyester film, it is preferable that the binder resin 12 comprises urethane resin, vinyl resin, and wax in combination, or vinyl resin and wax in combination. The binder resin 12 thus selected as a base material according to the type of the stretched film 3 contains a multiplicity of glass beads as granules having a particle size ranging from 5 to 45 $\mu$m. In this way, a multiplicity of glass beads 6 are randomly present in the coating layer 5 formed on the surface of the stretched film 3. The thickness of the binder resin mass 12 is approximately 2 to 3 $\mu$m, and the glass beads 6, which is placed in contact with the surface of the stretched film 3 positioned on the surface side of the pouch 1, project from the surface of the binder resin 12.

With the coating layer 5 positioned on the surface side, the aforesaid rectangular sheet is folded double and three sides of the sheet other than the folded portion 14 are closed by heat sealing, thereby forming the sealed pouch 1. After two of its three sides have been heat sealed, the sealed pouch 1 is packed with seasoning 11 or the like in liquid or powder form, and then the remaining one side is closed by heat sealing.

According to the above described construction, the coating layer 5 is formed on the entire surface of the stretched film 3 so that the coating layer 5 is present even in the edge portion of each heat sealed portion 2, with glass beads 6 being randomly present in the coating layer 5. Average spacing distance between adjacent glass beads 6, 6 is approximately 44 μm.

Figure 4:
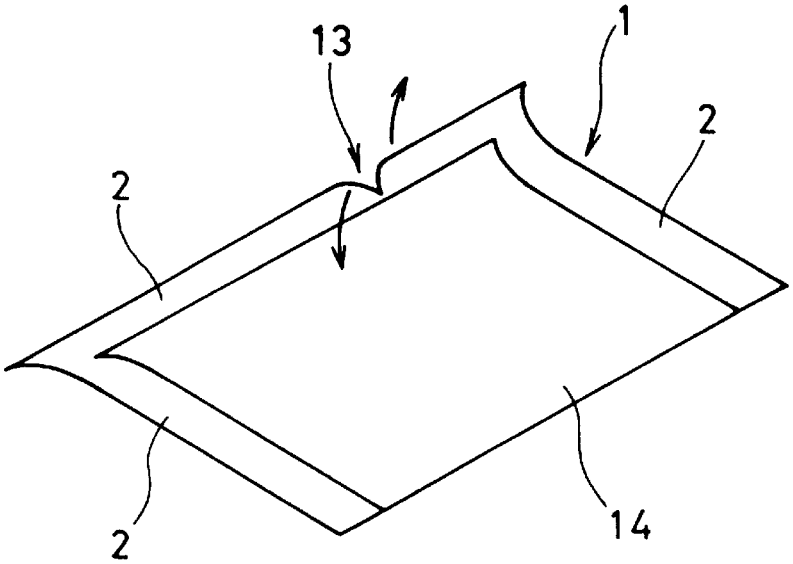
FIG. 4 is a perspective view showing the sealed pouch being torn.

To take out the content from the sealed pouch 1 of a quadrilateral configuration, a tearing force is applied to any one of the heat sealed portions 2 of the pouch 1 in a manner as shown in FIG. 4. Represented by 13 is a tearing portion to which a tearing force is applied. Then, the stretched film 3 is partially broken by glass beads 6 present in the portion to which the tearing force is applied, whereby the stretched film 3 and the unstretched film 4 bonded to the stretched film 3 can be easily torn off. If the average spacing distance between adjacent glass beads 6, 6 is more than 200 μm, it is rather difficult to rupture the sealed pouch 1 because the probability of presence of glass beads in the spot at which the tearing force is to be applied becomes low.

In FIGS. 1 to 4, a coating layer 5 containing glass beads 6 is present on the entire surface (i. e., both surfaces) of the sealed pouch 1. Alternatively, however, the coating layer 5 may be provided, for example, only at an edge portion of one of the heat sealed portions 2. In another alternative, the coating layer 5 may be provided only on one surface of the sealed pouch 1. In case that the coating layer 5 is provided only on one surface of the sealed pouch 1, if the coating layer 5 is deviated even slightly from any edge portion of the sealed pouch 1, no part of the coating layer 5 can be present in the edge portions of the sealed pouch 1, so that it becomes difficult to tear off the sealed pouch 1. Therefore, in order to realize easy tearing of the sealed pouch 1, it is necessary that the coating layer 5 be formed along the edge portions of the sealed pouch 1.

The coating layer 5 containing glass beads 6 need not necessarily be formed along the entire length of an edge portion of at least one side of the quadrilateral sealed pouch 1, but may be formed only in part of the edge portion in order for providing a tearing portion of the sealed pouch 1.

Figure 5:
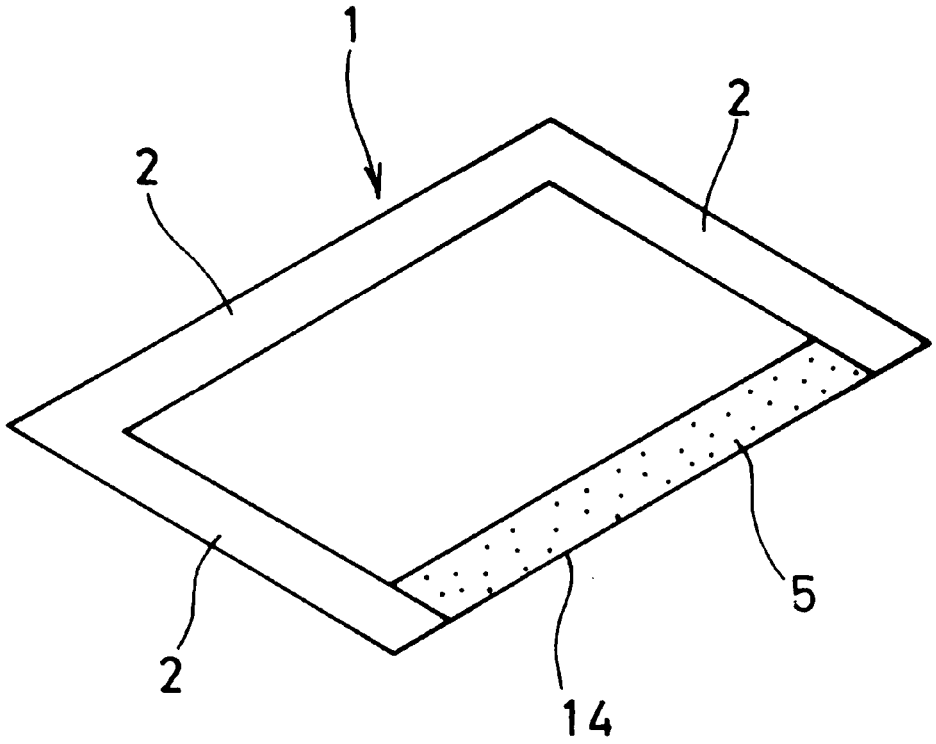
FIG. 5 is a perspective view of a sealed pouch representing another embodiment of the invention.
Figure 6:
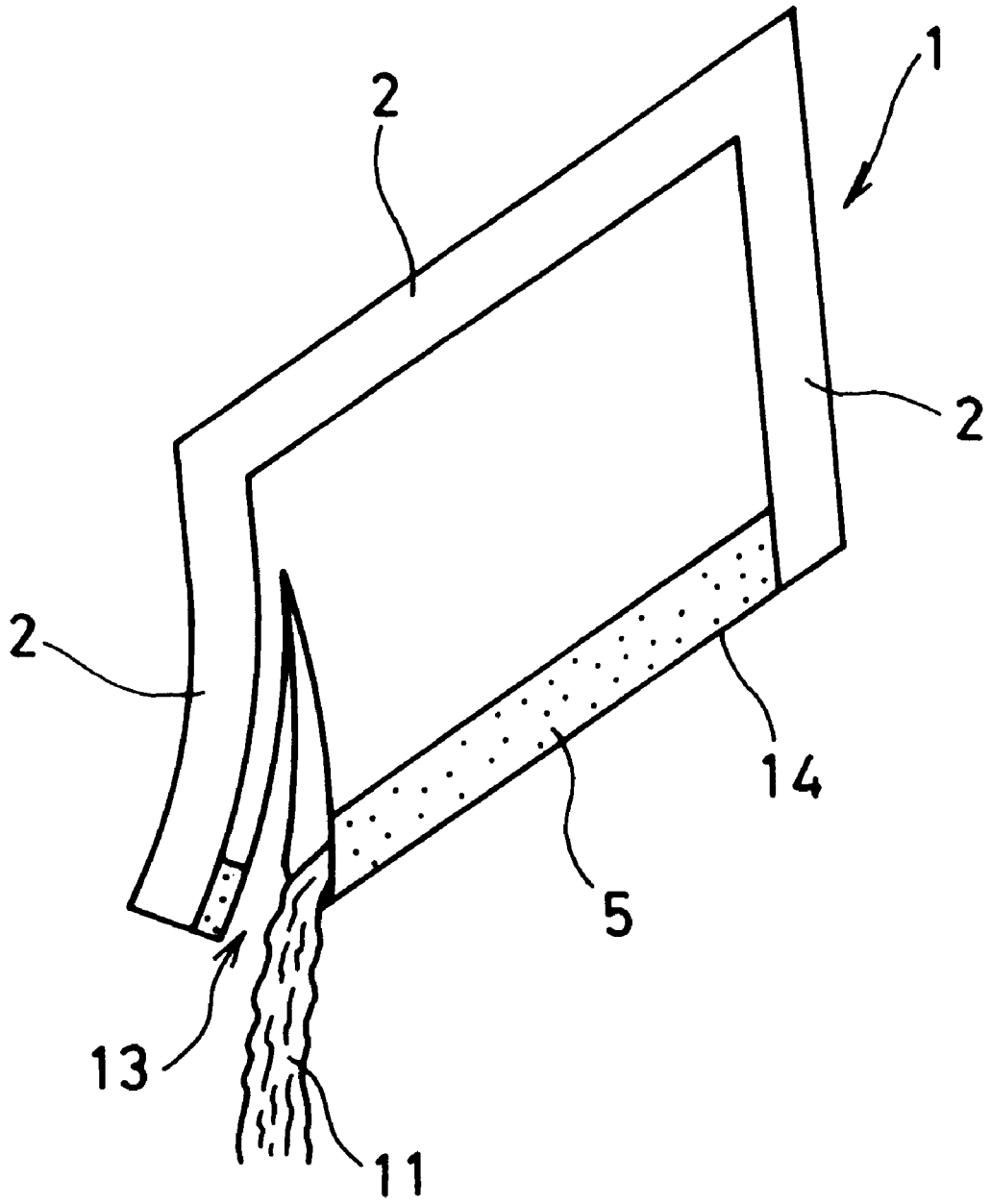
FIG. 6 is a perspective view showing the sealed pouch in FIG. 1 from which a content is being taken out.

The tearing of the sealed pouch 1 need not necessarily be effected only at any one of the heat sealed portions 2 on the three sides, but the tearing may be effected at the folded portion 14 instead. In this case, as shown in FIGS. 5 and 6, a coating layer 5 is formed at least along the folded portion 14 so as to enable the folded portion 14 to be torn at a suitable position for taking out the content 11 from the sealed pouch 1. Through this arrangement, when the content 11 of the pouch is taken out as illustrated in FIG. 6, the content, more particularly liquid content 11, flows down smoothly from a cut opening in the tearing portion 13, without being allowed to fall in drops along the heat sealed portion 2. In this way, takeout of the content 11 can be facilitated.

Figure 7:
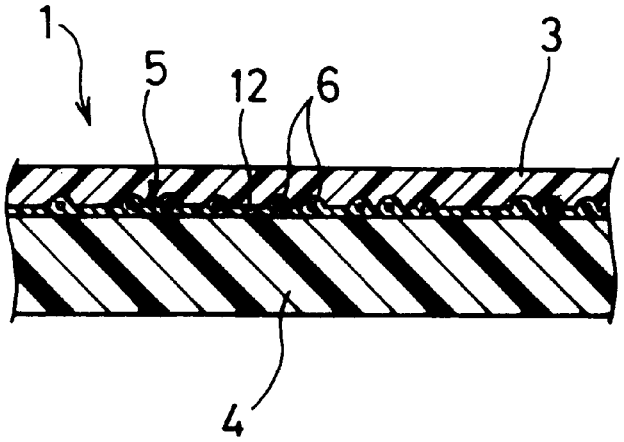
FIG. 7 is a view showing another form of sectional structure of the sealed pouch.
Figure 8:
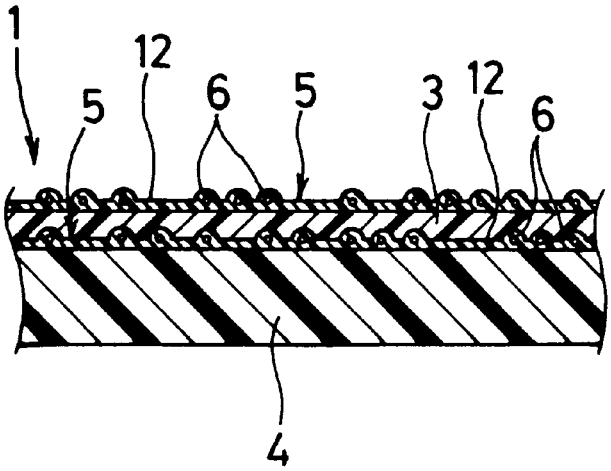
FIG. 8 is a view showing still another form of sectional structure of the sealed pouch.

In the sectional configuration shown in FIG. 3, the coating layer 5 is formed on the surface of the stretched film 3. As FIG. 7 illustrates, however, a coating layer 5 may be formed between the stretched film 3 and the unstretched film 4 which are to be bonded to each other. In this case, too, the same effect as of the FIG. 3 configuration can be obtained. Further, the coating layer 5 to be thus formed either on the surface of the stretched film 3 or between the stretched film 3 and the unstretched film 4 may comprise a plurality of such coating layers 5 which are layered one over another. In this case, when the sealed pouch 1 is plan-viewed, glass beads are densely present in the planar directions, and this permits easy tearing of the sealed pouch 1. In FIG. 8, coating layers 5 are indivisually formed on the surface of the stretched film 3 and between the stretched film 3 and the unstretched film 4. In this case, too, a similar effect can be obtained.

Figure 9:
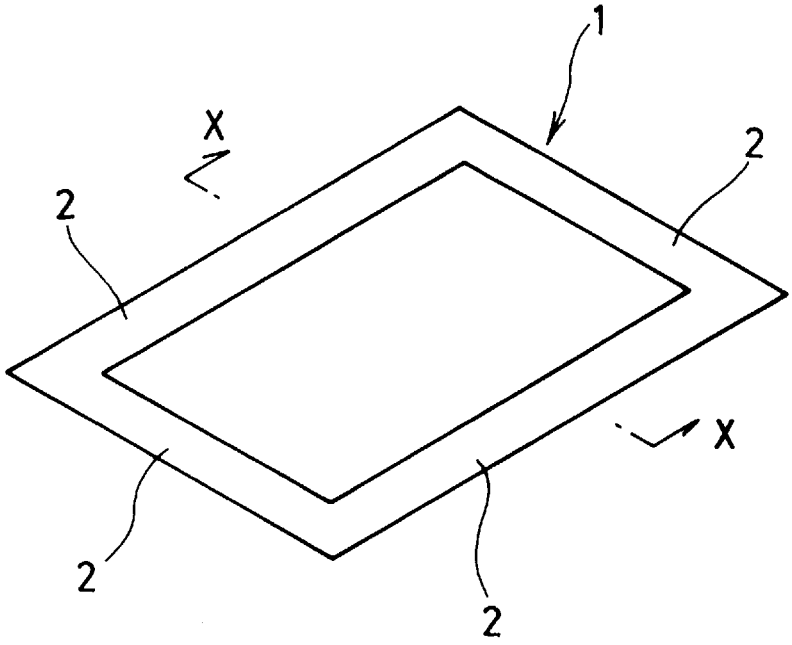
FIG. 9 is a perspective view of a sealed pouch representing still another embodiment of the invention.
Figure 10:
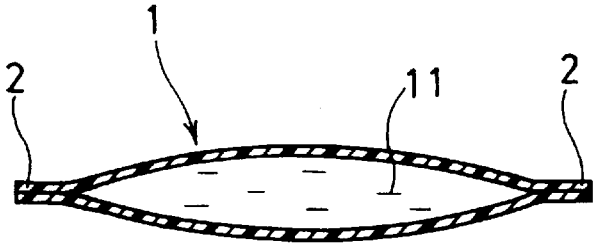
FIG. 10 is a section taken along line X—X in FIG. 9.
Figure 11:
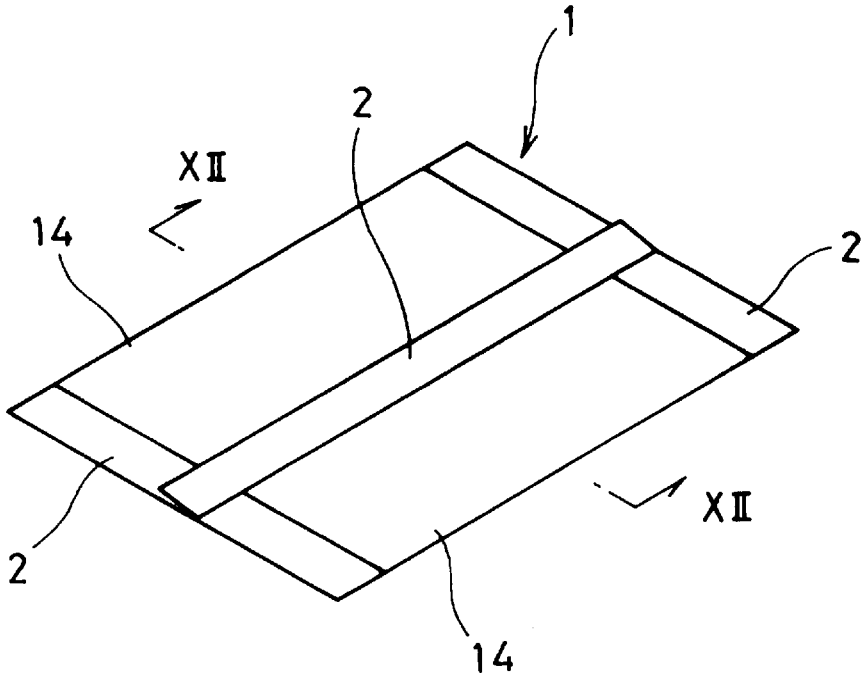
FIG. 11 is a perspective view of a sealed pouch representing a further embodiment of the invention.
Figure 12:
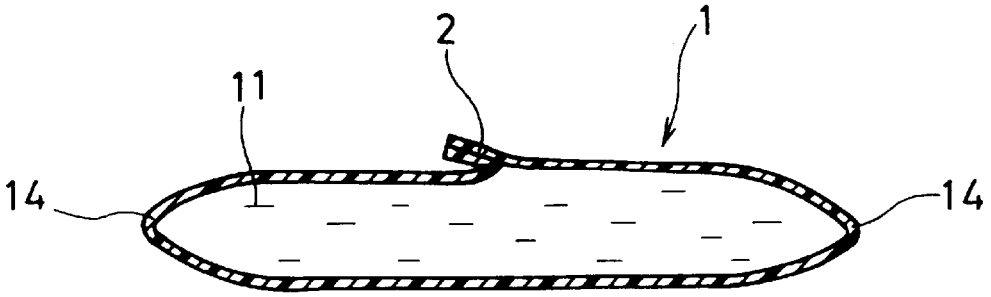
FIG. 12 is a section taken along line XII—XII in FIG. 11.
Figure 13:
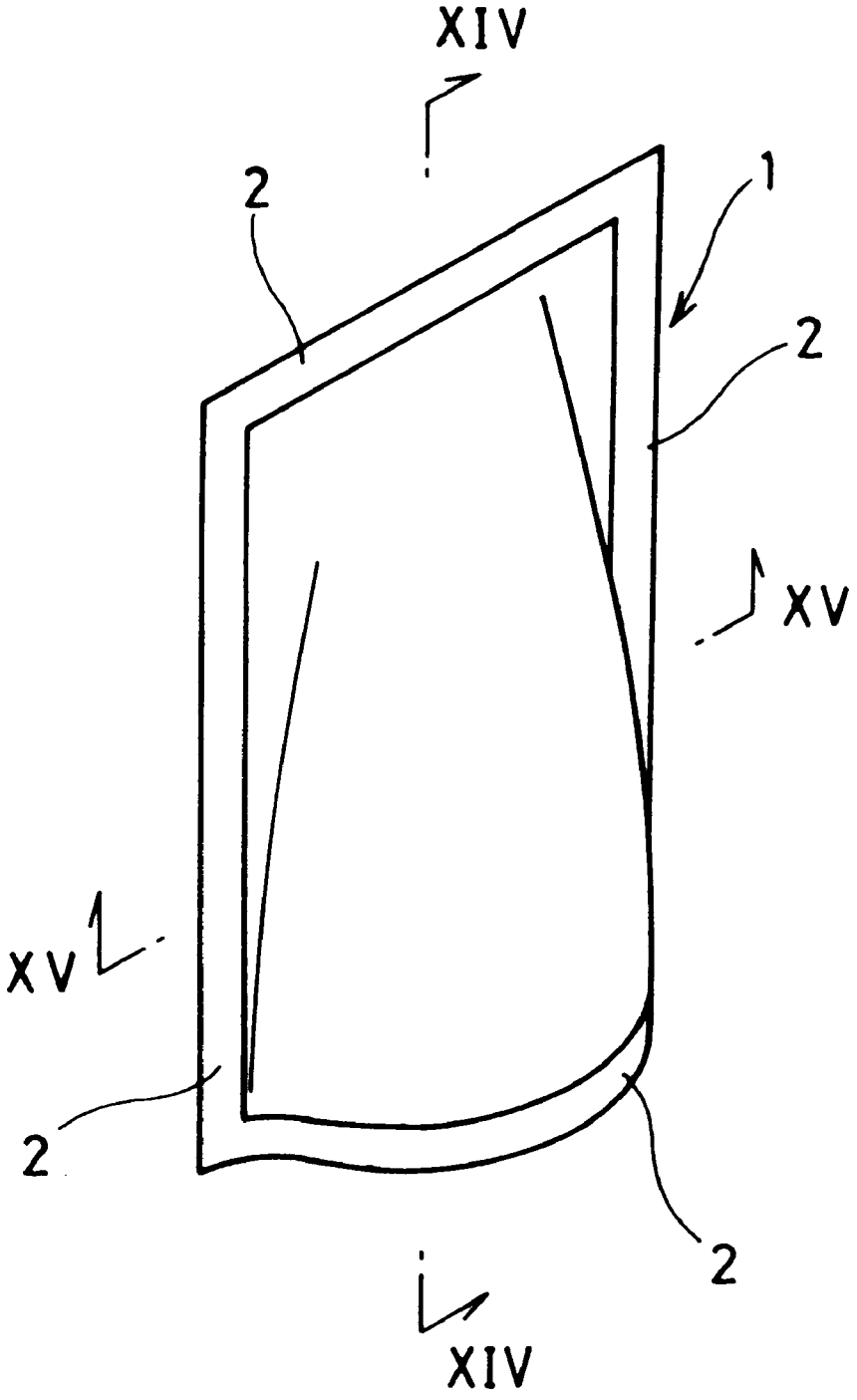
FIG. 13 is a perspective view of a sealed pouch representing a still further embodiment of the invention.
Figure 14:
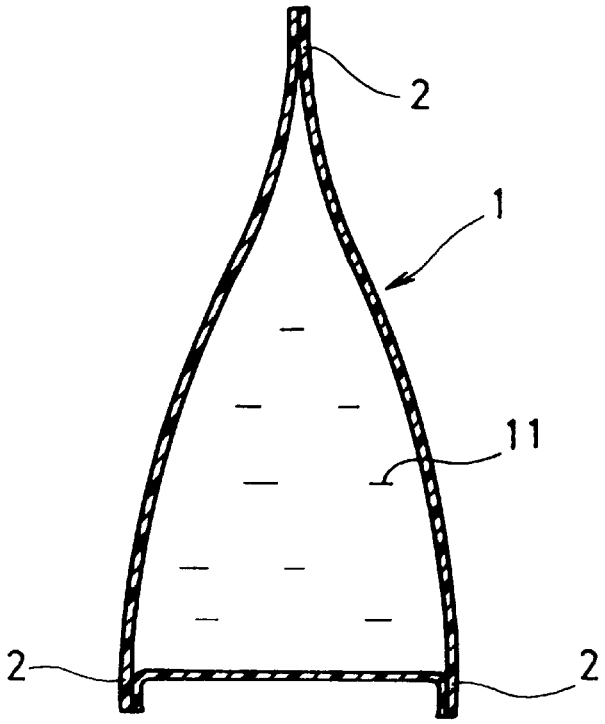
FIG. 14 is a section taken along line XIV—XIV in FIG. 13.
Figure 15:
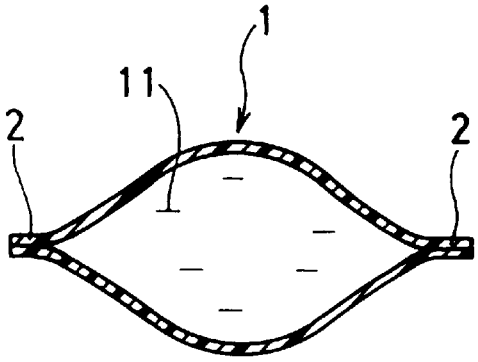
FIG. 15 is a section taken along line XV—XV in FIG. 13.
Figure 16:
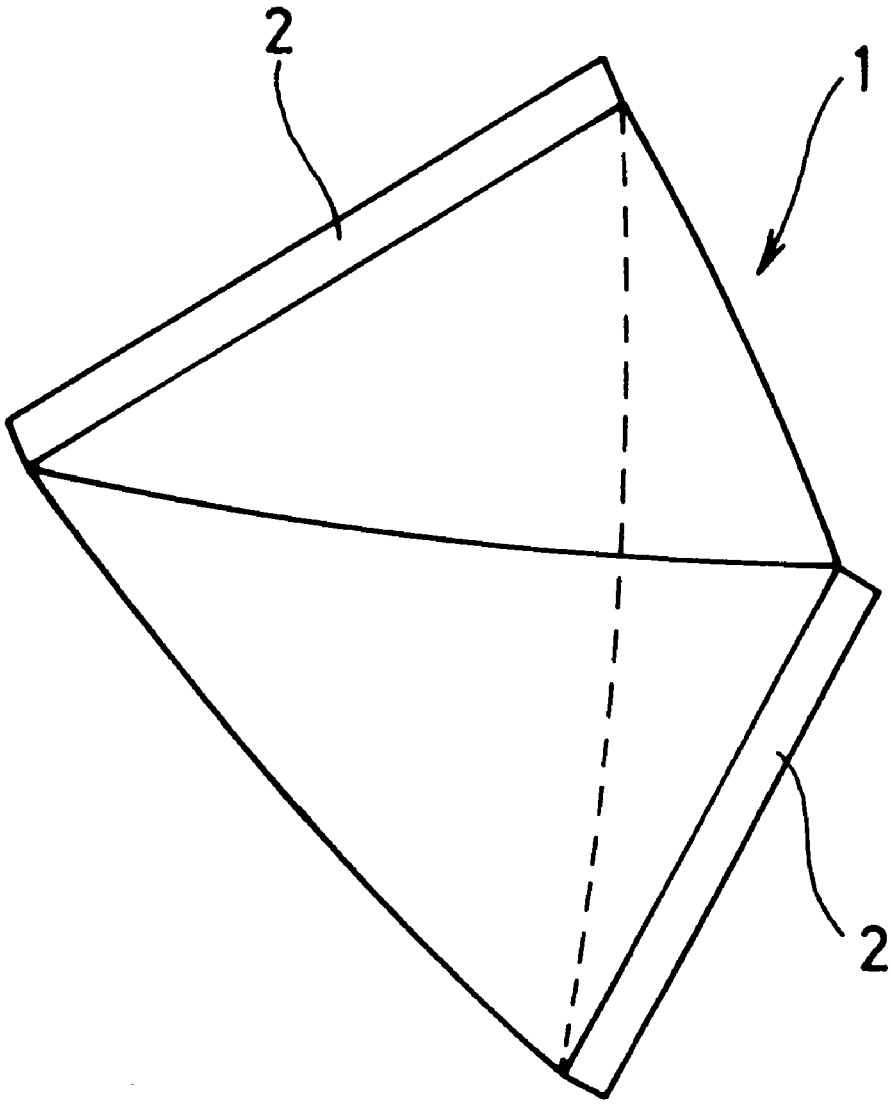
FIG. 16 is a perspective view of a sealed pouch representing still another embodiment of the invention.
Figure 17:
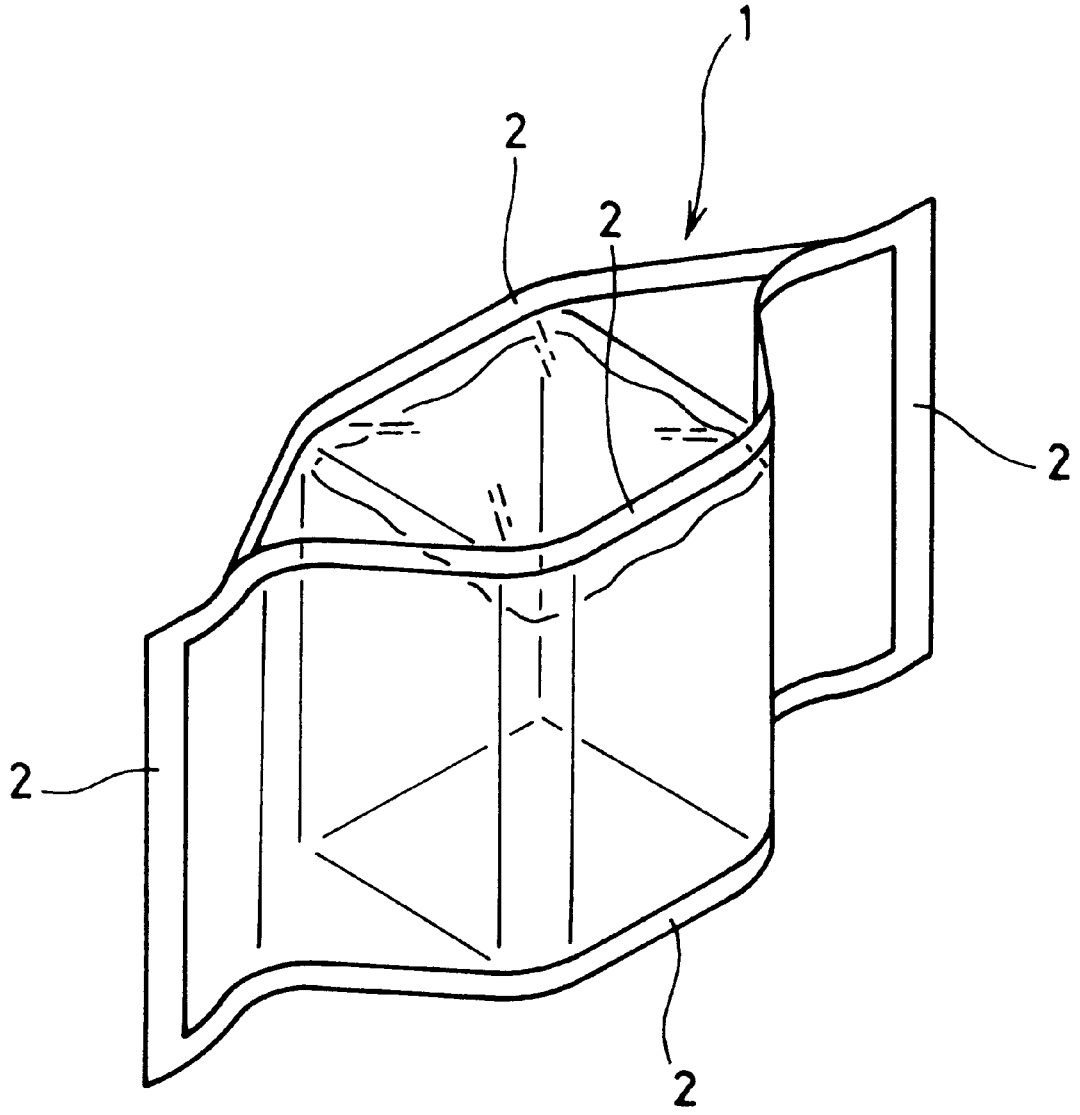
FIG. 17 is a perspective view of a sealed pouch representing a still further embodiment of the invention.

In addition to the configurations shown in FIGS. 1 through 6 in which three sides of the quadrilateral are heat sealed, the sealed pouch 1 may take such a configuration as shown in FIGS. 9 and 10 in which four sides of the quadrilateral are heat sealed. Also, the sealed pouch 1 may be configured to be of a pillow style as shown in FIGS. 11 and 12. Further, the sealed pouch 1 may take various other forms including a standing pouch configuration as shown in FIGS. 13 to 15, a triangular pyramid configuration as shown in FIG. 16, and a gusset style form as shown in FIG. 17 in which the pouch has four faces and is closed by heat sealing at longitudinally opposite ends. What is important is that a pouch has a determined portion at which the pouch is to be torn and cut, and that a coating layer as described above is formed at such portion.

Figure 18:
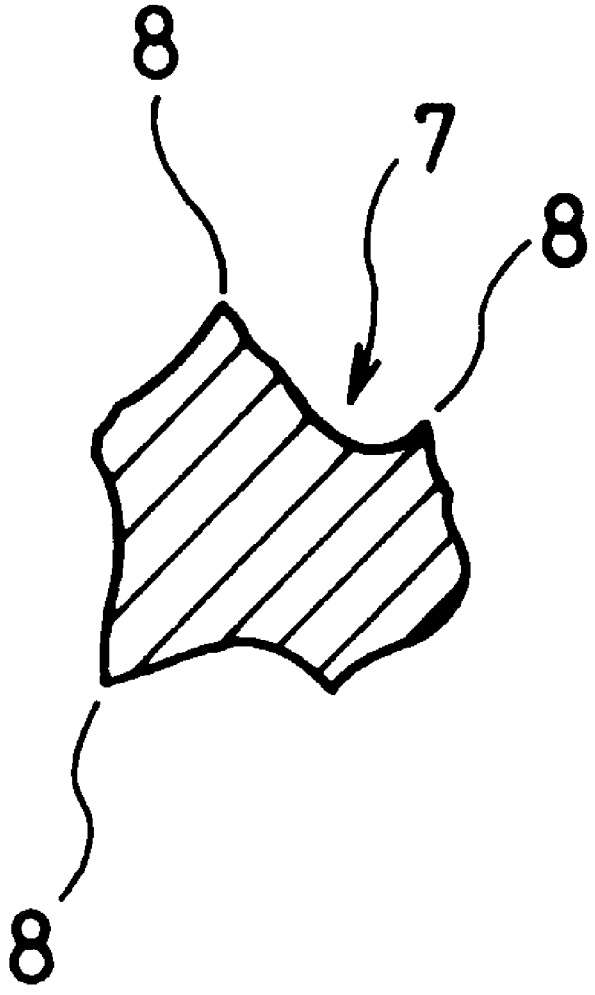
FIG. 18 is a sectional view showing one example of granule present in the coating layer of a sealed pouch made in accordance with the invention.

In the above description, the coating layer 5 contains granules of glass beads. In addition to glass beads, granules available for such use may be of ceramic, metal or the like. The granules may be of a spherical shape, or may be shaped to have pointed portions 8 on the surface thereof as shown in FIG. 18. The use of granules 7 having such pointed portions 8 on the surface further facilitates the tearing of the sealed pouch 1.

The article to be packaged in the sealed pouch 1 is in no way limited to seasoning 11 in liquid or powder form. The kind of film for forming a sealed pouch 1 may be suitably selected according to the kind of the article to be packaged in the sealed pouch 1. In addition to the above described laminated sheet comprising a biaxially oriented nylon film (stretched film 3) and an unstretched polyethylene film (unstretched film 4), it is possible to use, for example, a laminated sheet comprising a plurality of other synthetic resin films, or a laminated sheet comprising a synthetic resin film/films laminated with an aluminum foil or the like, to form a sealed pouch 1 in request.

What is claimed is:

1. An easily tearable sealed pouch made of a laminated sheet comprising a first layer of synthetic resin film and a second layer of material selected from the group consisting of synthetic resin film and aluminum foil, wherein the sealed pouch comprises a plurality of sides, at least one of the sides having an edge portion formed with a coating layer thereon which contains a binder resin mass and granules of material selected from the group consisting of ceramic, glass and metal, said granules being randomly present in the coating layer and having an average spacing between adjacent granules of not more than 200 μm; and whereby when a tearing force is applied to the edge portion of the sealed pouch having the coating layer, the laminated sheet is partially broken by the granules in the coating layer facilitating the tearing of the laminated sheet.

2. A sealed pouch as set forth in claim 1, wherein the coating layer is formed to extend along at least one side of the sealed pouch for its entire length.

3. A sealed pouch as set forth in claim 1, wherein the coating layer is formed in a portion of at least one side of the sealed pouch in the lengthwise direction of the side.

4. A sealed pouch as set forth in claim 1, wherein the coating layer is formed on the surface of the laminated sheet.

5. A sealed pouch as set forth in claim 1, wherein the coating layer is formed between the first layer of synthetic resin film and the second layer of material.

6. A sealed pouch as set forth in claim 1, wherein a plurality of coating layers are formed in the thickness direction of the laminated sheet.

7. A sealed pouch as set forth in claim 1, wherein the granules are glass beads.

8. A laminated sheet for forming an easily tearable sealed pouch as defined in claim 1, said laminated sheet comprising a first layer of synthetic resin film and a second layer of material selected from the group consisting of synthetic resin film and aluminum foil, wherein the laminated sheet includes a coating layer containing a binder resin mass and granules of material selected from the group consisting of ceramic, glass and metal, said granules being randomly present in the coating layer and having an average spacing between adjacent granules of not more than 200 $\mu$m; and whereby when a tearing force is applied to the edge portion of the sealed pouch having the coating layer, the laminated sheet is partially broken by the granules in the coating layer facilitating the tearing of the laminated sheet.

9. A sealed pouch as set forth in claim 1, wherein said granules have a particle size ranging from 5 to 45 $\mu$m.

10. A laminated sheet as set forth in claim 8, wherein said granules have a particle size ranging from 5 to 45 $\mu$m.

* * * * *